United States Patent [19]

Poirier

[11] 4,275,473

[45] Jun. 30, 1981

[54] MATTRESS

[76] Inventor: Jean B. Poirier, P.O. Box 781, Sallisaw, Okla. 74955

[21] Appl. No.: 60,504

[22] Filed: Jul. 25, 1979

[51] Int. Cl.[3] ..... A47C 27/08; A47B 83/04

[52] U.S. Cl. ..... 9/13; 9/310 E; 5/82 R; 5/417; 5/465; 5/473

[58] Field of Search ..... 5/82 R, 417, 420, 465, 5/473; 297/19; 9/11, 13, 14, 347, 348, 310 B, 310 E

[56] References Cited

U.S. PATENT DOCUMENTS

| | | | |
|---|---|---|---|
| 681,573 | 8/1901 | Nichols | 5/465 |
| 2,834,970 | 5/1958 | Nappe | 5/420 |
| 3,117,327 | 1/1964 | Mathhew | 297/457 |
| 3,293,671 | 12/1966 | Griffin | 297/457 |
| 3,308,088 | 4/1968 | D'Adesky | 5/420 |
| 3,775,782 | 12/1973 | Rice et al. | 5/82 R |

*Primary Examiner*—Casmir A. Nunberg
*Attorney, Agent, or Firm*—Burns, Doane, Swecker & Mathis

[57] ABSTRACT

A mattress is provided which is particularly suitable for use as a float in fresh water or salt water. The mattress is constructed of a plurality of light-weight, relatively rigid, buoyant blocks of substantially equal length. The blocks are preferably formed of cellular polystyrene. The blocks are held in side-by-side spaced relation by an outer skin formed of a material, preferably polyvinyl chloride film, which is capable of maintaining the integrity and orientation of the thus-formed mattress. The longitudinal edges of the buoyant blocks may be beveled so as to allow ease of rolling and folding of the mattress. A handle may be attached to one or both of the ends of the mattress.

3 Claims, 4 Drawing Figures

MATTRESS

BACKGROUND OF THE INVENTION

Mattresses which are capable of supporting a person on top of the water are known in the art. Many of these mattresses are of the inflatable type. However, such mattresses are subject to leaks and punctures, which render the mattress useless for its intended purpose.

Other floating mattresses obtain their buoyant properties from the materials from which they are constructed. Such mattresses do not suffer the disadvantage of being subject to leaks and punctures, as do the inflatable floats. One such float is shown in U.S. Pat. No. 1,829,137, which discloses a bathing float formed from a series of single pieces of cork, each of which is surrounded by a canvas covering. The float is held in a flat condition by a rod of wood passing through a series of canvas loops which are attached to the ends of the cork pieces. U.S. Pat. No. 2,257,103 discloses a life preserver having removable slats extending through a buoyant, but non-absorbing material, such as kapok, held in position by an upholstering material, such as canvas. The present invention is markedly superior to these mattresses in that it provides for flexibility in the length-wise direction, while having sufficient lateral rigidity for use as a float without requiring the use of reinforcing slats.

U.S. Pat. No. 3,380,088 also discloses a floating mattress made of buoyant blocks. However, this patent can be distinguished from the present invention by the manner in which the buoyant blocks are maintained in spaced, side-by-side relation.

It is an object of the present invention to provide a floating mattress having linear flexibility and comparative lateral rigidity.

It is an object of the present invention to provide a floating mattress which is durable and comfortable.

It is an object of the present invention to provide a floating mattress which is readily mountable while in deep water.

It is an object of the present invention to provide a mattress which may be readily rolled or folded for ease of transportation and storage.

It is an object of the present invention to provide a floating mattress which conforms to the shape of the body which it supports and flexes with any current or wave of the body of water in which it is being used.

It is an object of the present invention to provide a floating mattress which will continue to float regardless of puncturing.

It is an object of the present invention to provide a floating mattress which may be used in fresh water and salt water.

These and other objects of the invention will be apparent from the following detailed description and appended claims.

SUMMARY OF THE INVENTION

It is has been found that a mattress particularly suitable for use as a float in salt water and fresh water can be constructed of a plurality of light-weight, relatively rigid, buoyant blocks of substantially equal length. The blocks are held in side-by-side spaced relation by an outer skin formed of a material which is capable of maintaining the integrity and orientation of the thus-formed mattress. The blocks are preferably molded cellular polystyrene, and the outer skin is preferably polyvinyl chloride film. The longitudinal edges of the buoyant blocks may be beveled so as to allow rolling and folding of the mattress for ease of transportation and storage. This arrangement of a row of buoyant blocks held in spaced, side-by-side relation provides a mattress having, at the same time, linear flexibility and comparative lateral rigidity.

DETAILED DESCRIPTION OF THE INVENTION

The mattress of the present invention is illustrated in FIGS. 1–4.

Figure 1:
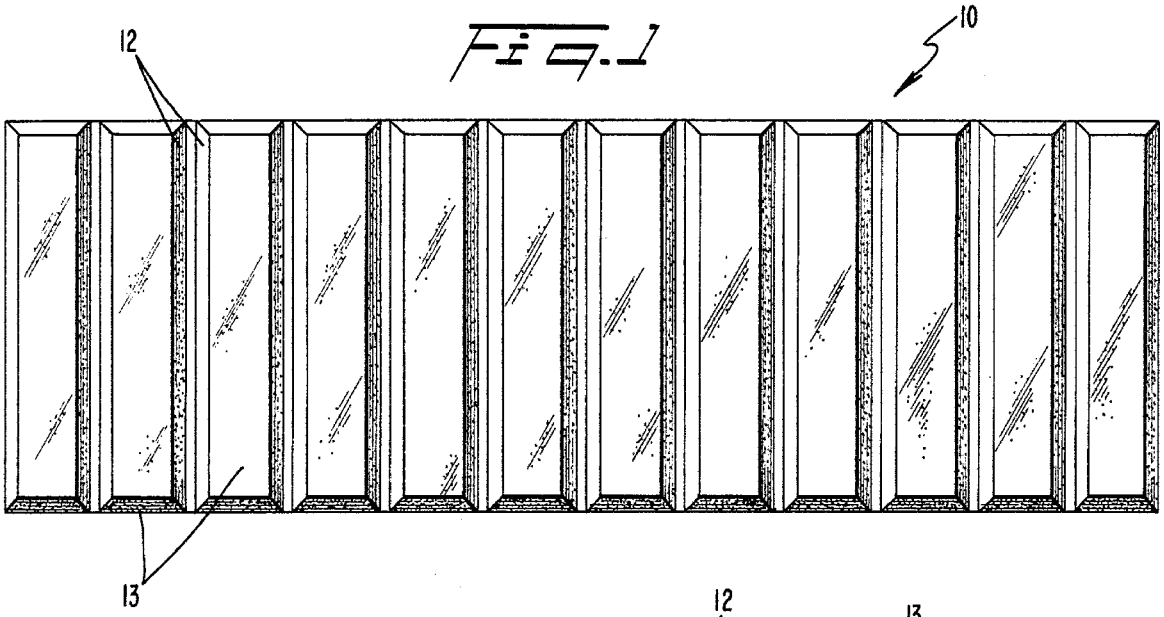
FIG. 1 is a top view of a mattress according to the present invention.
Figure 2:
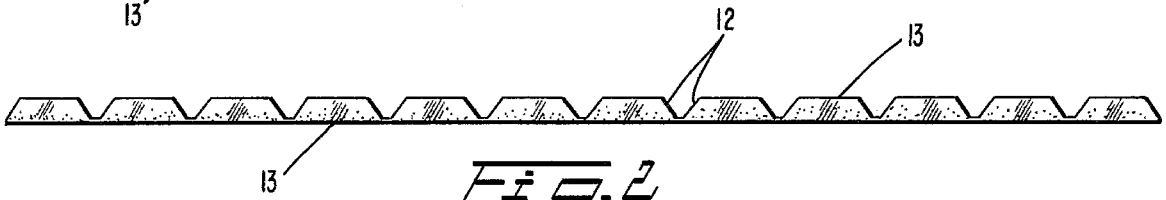
FIG. 2 is a side view of the same mattress.
Figure 3:
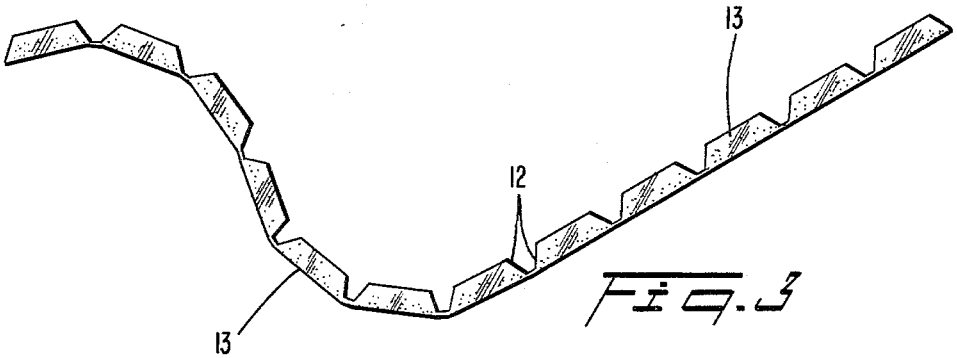
FIG. 3 is another side view of the same mattress, illustrating its linear flexibility.
Figure 4:
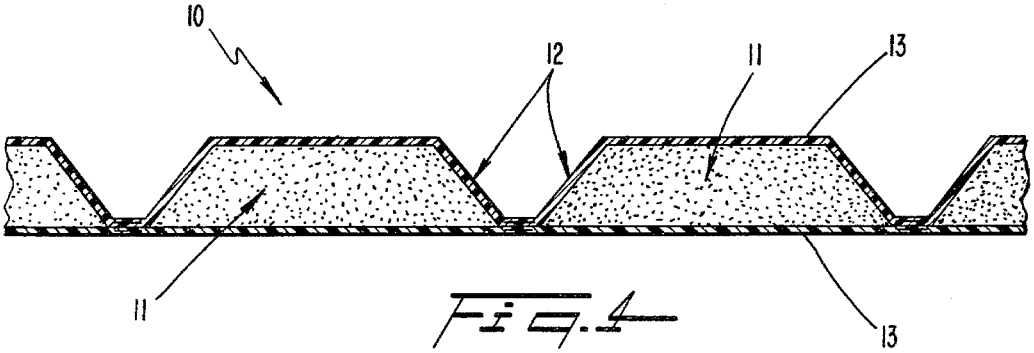
FIG. 4 is a close-up side view of the same mattress.

The mattress (10) is constructed of a plurality of light-weight, relatively rigid, buoyant blocks (11) of substantially equal length. It is to be understood that the term "blocks", as used herein, includes not only single, integral pieces of buoyant material molded in the desired size and shape, but also includes granules and loose particles of buoyant material which, when sealed inside an outer skin as described more fully below, form a mass of buoyant material having the desired size and shape. The buoyant blocks may be formed of any suitable material having a specific gravity substantially less than 1.0. Such materials include sponge rubber, granular polystyrene, cellular polyurethane, cellular polystyrene, etc. The cellular plastic materials may be either open-celled or closed-celled. A preferred material is cellular polystyrene. The longitudinal edges (12) of the buoyant blocks are spaced and may be beveled, as shown in FIG. 4, so as to allow rolling and folding of the mattress for ease of transportation and storage.

The buoyant blocks of which the mattress are constructed are held in side-by-side spaced relation by an outer skin (13) inside which or to which the blocks are sealed. The skin is constructed and arranged to maintain sufficient spacing between the blocks to permit rolling and folding of the mattress which facilitates handling and storage. The outer skin may be formed of any material which is capable of maintaining the integrity and orientation of the mattress. Such materials must be resistant to abrasion and mechanical loadings, but need not be waterproof. Suitable materials include flexible reinforced fabrics, polyethylene, polypropylene, polyvinyl chloride, etc. A preferred material is polyvinyl chloride film. When a plastic film is used as the outer skin, the film preferably has a thickness of approximately 0.006 to approximately 0.015 inches.

The buoyant blocks may be sealed within the outer skin in any convenient manner. For example, a plurality of buoyant blocks may be positioned upon a sheet of the material used to form the outer skin. A second sheet of the outer skin material may then be placed on top of the buoyant blocks, so that the top sheet falls between the beveled edges of the bouyant blocks and touches the bottom sheet. The two sheets may then be secured to one another by stitching, heat-sealing, ultrasonic-sealing, or any other convenient method.

The buoyant blocks are preferably spaced so that their bottom edges are approximately 0.25 to approximately 1.25 inches apart. This spacing provides the linear flexibility illustrated in FIG. 3. This linear flexibility allows the mattress to conform to the shape of the body which it supports and to flex with any current or wave of the body of water in which it is being used. However, the mattress possesses a comparative lateral rigidity, provided by the relatively rigid, buoyant blocks. This lateral rigidity allows the mattress to be easily mounted while in deep water and serves to resist the capsizing effect of wave action or movement by the occupying individual. It will be noted that the mattress obtains lateral rigidity without benefit of additional structural support, such as internal slats, and yet retains linear flexibility due to the absence of rigid linear support. The term "consisting essentially of" is used herein to reflect the absence of these rigid support elements.

The mattress may, optionally, be provided with a handle at one or both of the ends of the mattress for ease of carrying.

The mattress can be made in any convenient size. Especially preferred sizes are 60 inches by 24 inches and 72 inches by 24 inches. The individual buoyant blocks used in the mattress likewise may be of any convenient size, but an especially preferred size is 1 inch by 4 inches by 24 inches, and 15 blocks are commonly used for the large-sized mattress. When the preferred materials (cellular polystyrene and polyvinyl chloride film) are used to make the mattress, the mattress has a density of approximately 1 pound per cubic foot.

It should be apparent to those of ordinary skill in the art that the described characteristics of the mattress also make it suitable for a variety of non-aquatic environments such as a protective pad or pallet for sleeping bags or picnic blankets.

Although the invention has been described with preferred embodiments, it is to be understood that variations and modifications may be employed without departing from the concept of the invention as defined in the following claims.

I claim:

1. A mattress having linear flexibility and comparative lateral rigidity, said mattress comprising a plurality of light-weight, relatively rigid, buoyant blocks of substantially equal dimensions formed of a cellular plastic material, said blocks having bevelled longitudinal edges and said blocks being held in side-by-side spaced relation by an outer skin of a plastic film having a thickness of approximately 0.006 to 0.015 inches, and wherein said outer skin is formed by stitching or sealing together between said blocks a sheet of said film positioned above said blocks and a sheet of said film positioned below said blocks and wherein said blocks are spaced approximately 0.25 to approximately 1.25 inches apart whereby the mattress may be rolled with the bevelled edges internally located and wherein said mattress has a handle attached to one or both of the ends thereof.

2. The mattress of claim 1, wherein said cellular plastic material is celluar polystyrene.

3. The mattress of claim 1, wherein said plastic film is polyvinyl chloride film and wherein the sheet below the blocks is in substantially planar configuration when the mattress is extended.

* * * * *